US005551772A

United States Patent [19]

Keffer

[11] Patent Number: 5,551,772

[45] Date of Patent: Sep. 3, 1996

[54] JEWELRY FRAME

[76] Inventor: Michael E. Keffer, 11222 S. Bryant, Oklahoma City, Okla. 73160

[21] Appl. No.: 398,836

[22] Filed: Mar. 6, 1995

[51] Int. Cl.[6] ..... A47F 3/00; A45C 11/04; B65D 73/00

[52] U.S. Cl. ..... 312/114; 312/111; 206/6.1; 211/13; 211/90

[58] Field of Search ..... 312/114, 119, 312/204, 126, 111, 257.1; 206/6.1; 211/187, 188, 153, 13, 90; 403/231, 245

[56] References Cited

U.S. PATENT DOCUMENTS

| | | | |
|---|---|---|---|
| 3,059,983 | 10/1962 | Strom | 312/111 X |
| 3,634,983 | 1/1972 | Welch | 211/90 X |
| 3,844,634 | 10/1974 | Kruger et al. | 312/257.1 X |
| 4,353,663 | 10/1982 | Glickman | 403/231 X |
| 4,639,161 | 1/1987 | Mazaki | 403/231 X |
| 4,662,519 | 5/1987 | Ciociola | 312/204 X |
| 4,735,471 | 4/1988 | Riggsley | 211/187 X |
| 4,923,069 | 5/1990 | Germain et al. | 211/13 |
| 4,958,727 | 9/1990 | Bergeron | 206/6.1 |
| 5,253,750 | 10/1993 | Keffer | 206/6.1 |

FOREIGN PATENT DOCUMENTS

| | | | |
|---|---|---|---|
| 3919517 | 7/1990 | Germany | 206/6.1 |

*Primary Examiner*—Peter M. Cuomo
*Assistant Examiner*—James O. Hansen
*Attorney, Agent, or Firm*—Robert K. Rhea

[57] ABSTRACT

An elongated upright rectangular frame surrounds a backboard having a front surface overlaid by a coextensive section of fabric material is provided with a monofilament strand tautly stretched across the fabric and backboard front and back surface from opposing sides thereof defining a series of longitudinally spaced parallel runs of the strand on the visable portion of the backboard for supporting a plurality of jewelry pieces when placed thereon. The frame further includes a plurality of shelves supported by vertically spaced pairs of knobs on the inner surfaces of opposite side panels of the frame. A shelf and drawer unit is similarly removably supported by pairs of knobs in which the drawers may be separately removed from the unit or the entire unit removed from the frame. Additionally, a series of horizontally inwardly projecting dowel-like rods support necklaces and the like.

1 Claim, 2 Drawing Sheets

JEWELRY FRAME

BACKGROUND OF THE INVENTION

1. Field of the Invention

This invention relates to a support for storing and displaying various types of jewelry and other valuable and wearable items.

Jewelry is commonly stored in jewelry cabinets, jewelry boxes, and other containers for storing and displaying different types of jewelry such as wall mounted or self-supporting stands, earring pouches or ring stands. However the above items are often expensive and will not satisfactory store or display all the different types of jewelry and other small wearable items such as hair clips, watches, headbands, and so forth.

This invention provides an upright open front frame having a backboard or wall for hanging all types of earrings, hair clips and other jewelry items thereon and further includes rod members from which strands of necklace may be hung and a drawer and shelf unit including a plurality of small sliding drawers for jewelry items not capable of being supported on a jewelry rack.

2. Description of the Prior Art

The most pertinent patent is believed to by my U.S. Pat. No. 5,253,750 issued Oct. 19, 1993 for JEWELRY FRAME. This patent discloses a wall mounted frame having a backboard covered with a layer of fabric material capable of receiving pins and other jewelry when attached thereto and further includes a monofilament line secured at its respective ends to the backboard and transversely wrapped therearound to define a plurality of parallel horizontal runs of the line across the front surface of the backboard and the fabric thereon from which various items of jewelry may be suspended.

U.S. Pat. No. 4,923,069 issued May 8, 1990 to Germain for APPARATUS FOR STORING AND DISPLAYING JEWELRY and U.S. Pat. No. 4,958,727 issued Sep. 25, 1990 to Bergeron for SHOWCASE FOR STORING AND DISPLAYING POST-TYPE EARRINGS are examples of the further state-of-the-art. The Germain patent discloses a frame supported backboard formed from jewelry post penetratable material for supporting jewelry articles thereon and the Bergeron patent discloses a plurality of hingedly connected box-like compartments for storing jewelry items and the like.

This invention includes the backboard of my U.S. Pat. No. 5,253,750 having vertical spaced parallel runs of the wrap around monofilament jewelry supporting line, but additionally includes a box-like open front frame having vertical side panels provided with a plurality of confronting vertically spaced knobs on its vertical side surfaces which removably support a series of vertically spaced shelf-like platforms including a ring holder and a plurality of drawers for containing small items of jewelry not readily adapted for support by the monofilament line or rods mounted on the frame for supporting strands of necklaces.

SUMMARY OF THE INVENTION

An open front rectangular upright frame having interconnected top, bottom, and side walls surrounding a backboard forming a closed back. The backboard having a monofilament strand wrapped therearound forming a plurality of parallel equally vertically spaced runs of monofilament strand on which jewelry may be hung.

The confronting surfaces of the frame side walls are provided with pairs of small knobs projecting toward each other in confronting equally spaced vertical relation for removably supporting a plurality of shelf-like platforms horizontally dividing the jewelry frame. Cooperating upper and lower shelf platforms removably support a plurality of drawers for storing small items of jewelry and a ring rack. The frame wall also supports a plurality of pegs or rods for supporting strands of jewelry, such as necklaces.

The principal objects of this invention are to provide a device for the storage and display of a relatively large quantity of jewelry and small wearable items and form an attractive and artistic display which features ease of locating and accessing each and every selected individual item.

DESCRIPTION OF THE PREFERRED EMBODIMENTS

Figure 1:
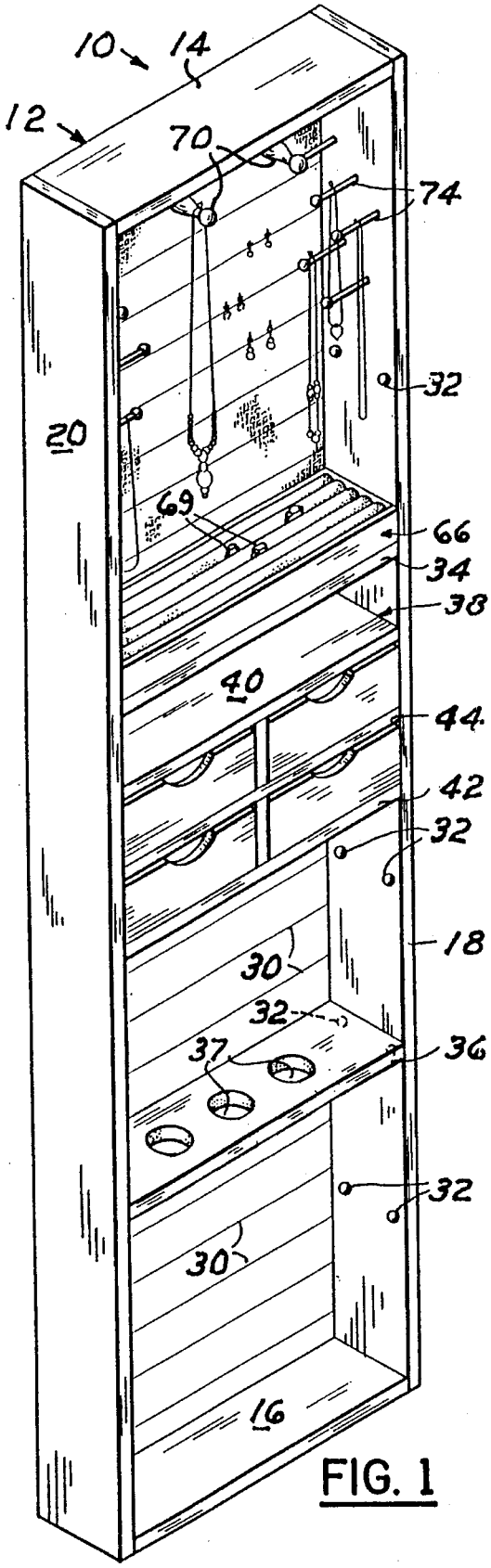
FIG. 1 is a perspective view of a jewelry case.
Figure 2:
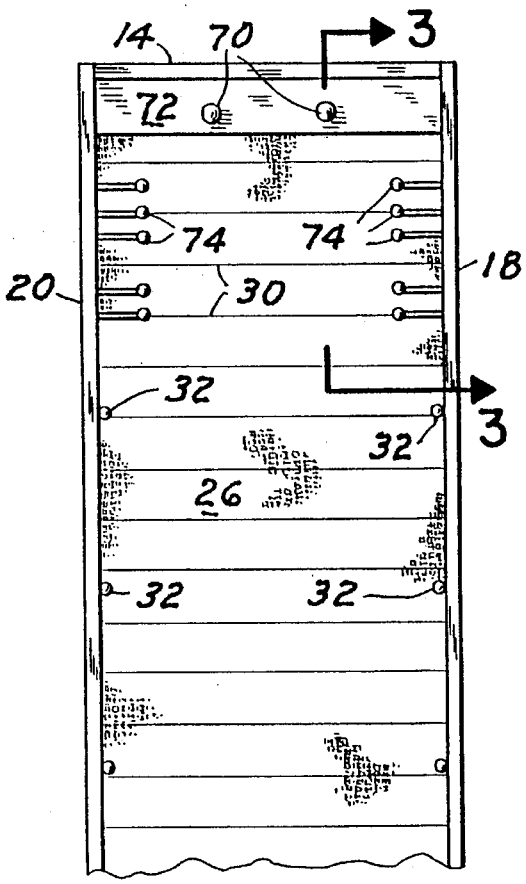
FIG. 2 is a fragmentary elevational view of the upper portion of FIG. 1 with jewelry case components removed.

Like characters of reference designate like parts in those figures of the drawings in which they occur.

The reference numeral 10 indicates the device as a whole which is rectangular elongated upright box-like in general configuration. The device 10 comprises a frame 12 formed by a top 14 a bottom 16 and right and left side panels 18 and 20, respectively rigidly joined together to form a box-like frame with the panels having inner and outer surfaces and forward and rearward edge surfaces.

Figure 3:
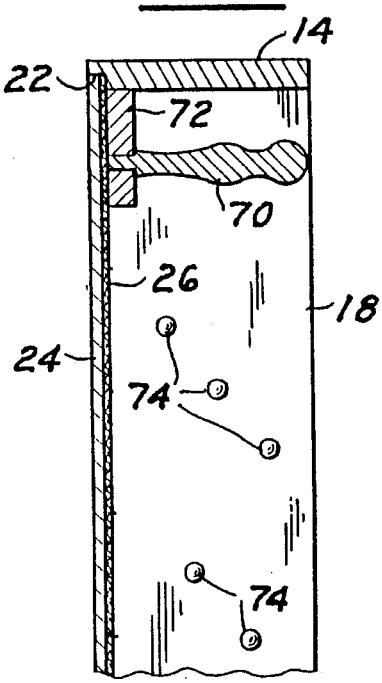
FIG. 3 is a fragmentary vertical cross-sectional view, to a larger scale, taken substantially along the line 3—3 of FIG. 2.
Figure 4:
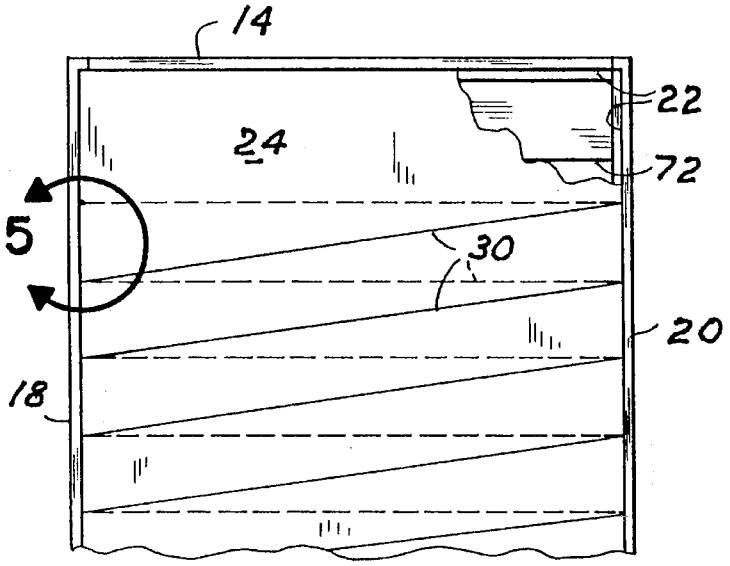
FIG. 4 is a fragmentary rear elevational view of the upper portion of the jewelry case with a portion broken away for clarity.

The rearward edge surfaces of the panels are rabbitted, as at 22 (FIG. 3), for receiving a back panel or backboard 24 and adding rigidity to the frame. The forward surface of the backboard is covered with a layer of fabric-like material 26 having a pleasing appearance.

Figure 5:
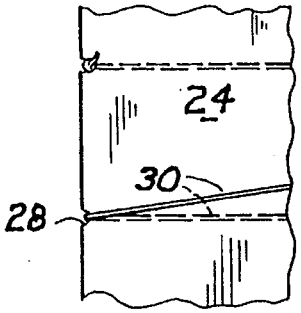
FIG. 5 is a fragmentary elevational view, to a further enlarged scale, of that area encompassed by the arrow 5 of FIG. 4.

The respective longitudinal side edges of the backboard 24 are provided with a series of vertically spaced-apart notches 28 (FIG. 5). An elongated length of monofilament elastomeric line or strand, secured at one end portion to the upper end portion of the backboard, is extended horizontally across the front of the fabric material 26 through respective slots at back opposite sides of the backboard and angularly inclined from an upper slot to a lower slot on the back side of the backboard throughout its vertical length and is secured at its opposite end portion to the lower end portion of the backboard in a manner similarly disclosed in my above referred to patent and for a similar purpose, namely, supporting small jewelry items which are capable of being attached to a monofilament strand.

The inner surface of the frame side panels 18 and 20 are each provided with a series of vertically spaced pairs of knobs 32 disposed in confronting relation with the pair of knobs on the opposite frame side panel. Each pair of knobs 32 are horizontally spaced-apart and disposed adjacent the forward and rearward edge, respectively, of the respective side panel inner surface.

Figure 6:
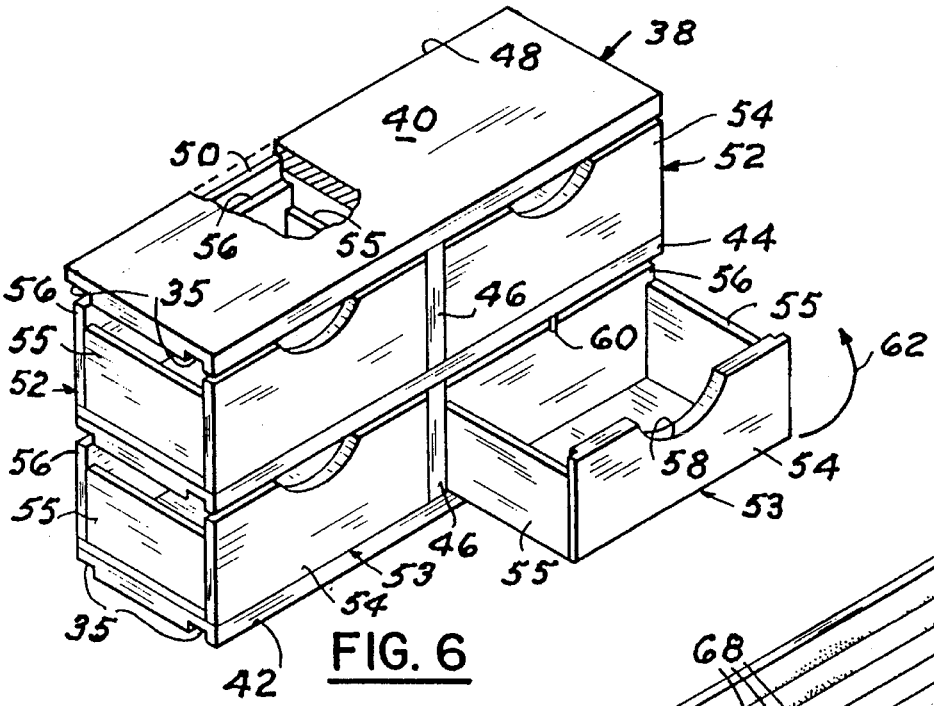
FIG. 6 is a perspective view of the shelf and drawer unit, per se.

The purpose of the pairs of knobs 32 is for horizontally supporting a plurality of rectangular panels 34 and 36 and forming a plurality of shelves. The bottom surface of the respective end portion of each shelf panel is provided with a pair of socket-like recesses 35 (FIG. 6) open downwardly and through the respective shelf end surface and cooperatively spaced for nesting respective pairs of the knobs 32. Three shelf panels form a drawer unit 38. The drawer unit 38 comprises upper and lower shelves 40 and 42, similarly provided with the recesses 35 and supported at their respective ends by pairs of the knobs 32. An intermediate shelf 44 is interposed between the upper and lower shelves 40 and 42 and is maintained in parallel equally spaced relation with respect to the upper and lower shelves by a pair of dividers or partitions 46 interposed between the intermediate shelf and the upper and lower shelf, respectively, medially their ends. The depending surface of the rearward edge portion 48 of the upper shelf 40 is rabbitted for receiving a drawer stop panel 50 secured at its upper edge portion within the rabbit of the top shelf and is rigidly secured to the rearward edges, not shown, of the dividers 46 and rearward edge surfaces of the lower and intermediate shelves to form upper and lower drawer receiving compartments receiving a plurality (two pairs) of drawers 52 and 53.

The pairs of drawers 52 are of substantially conventional construction having a front panel 54, and a rearward drawer panel 56 both joined with a drawer bottom panel by drawer side panels 55 freely received in the vertical spacing between the intermediate shelf and the upper and lower shelves.

The drawer front panels 54 have a recess 58 in the upper edge portion for ease of removing the drawers from the drawer unit 38. A stop pin 60, only one being shown, depends from the forward edge portion of the top shelf and intermediate shelf, which intersects the top edge portion of the respective drawer back panel 56 when removing the drawer to prevent accidental separation of the drawer from the shelf unit and spilling contents of the drawer.

The respective drawer may be easily removed from or installed in the drawer unit by lifting the front panel portion 54 of the respective drawer upwardly in the direction of the arrow 62 which disengages the stop pin 60 from the drawer back wall 56.

The side walls 55 of the uppermost pair of drawers 52 adjacent the respective frame side panel 18 and 20 prevent removal of the shelf and drawer unit 38 from the confines of the frame 12 until the uppermost pair of drawers 52 are removed from the unit.

Figure 7:
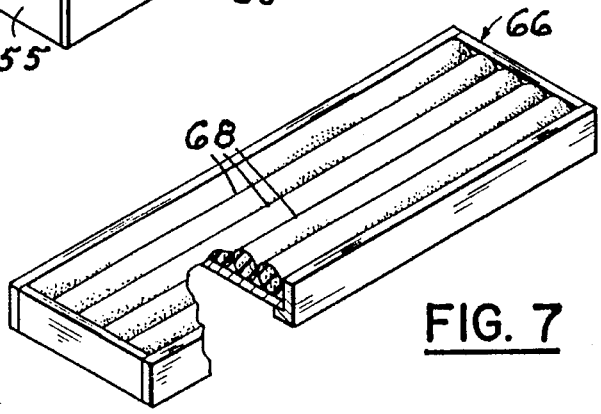
FIG. 7 is a perspective view of the ring holding platform partially in section.

The device 10 includes a ring holding shelf 66 (FIG. 7) which is box-like in general configuration dimensioned to rest on one of the shelves 34 or the top shelf of the shelf and drawer until 38.

The shelf unit 66 contains a series of cylindrical-like rubber or elastomeric foam material 68 arranged in longitudinal juxtaposed relation for receiving a peripheral portion of finger rings 64 (FIG. 1) when manually forced into indentations defined by the foam material. Other specialized shelves, such as the shelf 36, may be provided with apertures 37 for supporting other articles such as a gun, not shown, if desired.

A pair of decorative support rods 70 are horizontally mounted at one end portion in parallel spaced relation on the medial portion of a frame brace panel 72 secured at its top and end edges to the inner rearward surface of the frame top panel 14 and respective side panel 18 and 20. The rods 70 extend forwardly terminating substantially in the vertical plane defined by the forward edge surfaces of the top, bottom, and side panels of the frame 12.

A plurality of other dowel-like necklace, supports 74 each having a part-spherical free end portion are secured at their other end portions in parallel row forming relation to the inward surface of the upper end portion of the side panels 18 and 20. The several dowel-like supports 74 project toward each other in confronting relation, a selected distance.

Obviously the invention is susceptible to changes or alterations without defeating its practicability. Therefore, I do not wish to be confined to the preferred embodiment shown in the drawings and described herein.

I claim:

1. A free standing jewelry cabinet, comprising:

a generally rectangular open front frame formed by interconnected top, bottom and right and left side wall panels having front and rear edge portions and having inner and outer surfaces;

a backboard secured to the rear portions of the top, bottom and right and left side panels;

a fabric-like material having a pleasing appearance overlying a visually perceivable surfaces of the backboard;

an elongated monofilament elastomeric strand of uniform diameter tautly wrapped around said backboard over the fabric like material thereon for forming a plurality of parallel equally vertically spaced strand runs for supporting jewelry items when attached thereto;

a plurality of pairs of horizontal and vertically equally spaced-apart knobs secured to the inner surface of said right and left side wall panels in confronting relation with respect to the respective pairs of knobs on the opposite side panel;

a plurality of shelf panels each having opposing end surfaces and top and bottom surfaces and extending horizontally between said right and left side panels, each shelf panel having a pair of recesses adjacent its respective end open through its bottom and end surfaces for cooperatively nesting respective opposing pairs of said pairs of knobs and preventing horizontal outward movement of the shelf panels relative to said frame;

shelf and drawer means removably supported in the frame for storing relatively small jewelry items, said shelf and drawer means comprising:

upper, lower and intermediate vertically spaced-apart shelf panels each having opposing end surfaces and top and bottom surfaces and extending horizontally between said right and left side panels, each shelf panel of said upper, lower and intermediate shelf panels having a pair of recesses adjacent its respective end open through its bottom and end surfaces for cooperatively nesting respective opposing pairs of said pairs of knobs and preventing horizontal outward movement of said upper, lower and intermediate shelf panels relative to said frame side panels;

a partition transversely interposed between and medially the end surfaces of said intermediate shelf panel and said upper and lower shelf panels, respectively, for forming a drawer receiving space between opposite sides of the respective said partition and the adjacent said frame side panel; and, a drawer removably contained by the respective drawer space.

* * * * *